United States Patent [19]

Meredith

[11] Patent Number: 4,458,907

[45] Date of Patent: Jul. 10, 1984

[54] SKATEBOARD

[76] Inventor: Deanna R. Meredith, 320 E. Noleman #4, Centralia, Ill. 62801

[21] Appl. No.: 404,207

[22] Filed: Aug. 2, 1982

[51] Int. Cl.[3] ..... A63C 17/02

[52] U.S. Cl. ..... 280/87.04 A; 280/87.05; 403/379

[58] Field of Search ..... 441/68, 74; 403/379; 108/89, 64, 83, 90; 280/11.26, 11.16, 87.04 R, 87.04 A, 87.05, 638, 35, 142

[56] References Cited

U.S. PATENT DOCUMENTS

| | | | |
|---|---|---|---|
| 1,310,218 | 7/1919 | Silver | 280/87.05 |
| 2,190,316 | 2/1940 | Harris | 280/11.26 |
| 2,933,325 | 4/1960 | Akins | 280/35 |
| 3,235,282 | 2/1966 | Bostick | 280/87.04 A |
| 3,309,098 | 3/1967 | Parker | 280/11.26 |
| 3,313,510 | 4/1967 | Madaho | 108/83 X |
| 3,385,608 | 5/1968 | Waddell | 280/87.04 A |
| 3,409,920 | 11/1968 | Brownley | 441/74 |
| 3,635,854 | 1/1972 | Martin | 280/11.26 |
| 3,834,722 | 9/1974 | Rainer | 280/603 |
| 3,993,318 | 11/1976 | Rothmayer | 280/11.26 |

FOREIGN PATENT DOCUMENTS

| | | | |
|---|---|---|---|
| 2448362 | 10/1980 | France | 280/11.26 |

*Primary Examiner*—Joseph F. Peters, Jr.
*Assistant Examiner*—Michael Mar
*Attorney, Agent, or Firm*—Brooks & Kushman

[57] ABSTRACT

A skateboard (10) having front and rear members (12,22) with associated set of wheels (18,28) and having a removable insert (32) for providing extended or retracted lengths of the skateboard. Connectors (34,36,38,40) which are preferably of the male and female type secure front member (12) directly to the rear member (22) in the retracted length or with the insert (32) therebetween in the extended length. Laterally spaced sets of the connectors (34,36,38,40) are preferably provided and are locked in position by a pair of locking devices (42) in the extended length or by one of the locking devices (42) in the retracted length.

8 Claims, 5 Drawing Figures

SKATEBOARD

TECHNICAL FIELD

This invention relates to skateboards.

BACKGROUND ART

Skateboards such as of the type disclosed by U.S. Pat. No. 3,235,282 conventionally include an elongated board having a lower surface on which front and rear wheels are mounted and also having an upper surface on which the person stands during riding of the skateboard. Heretofore, skateboards have had only a single length such that it was not possible for an adult to use a skateboard having a length designed for a child since for the adult this length would not provide sufficient standing area on the skateboard. Likewise, a child using a skateboard having a long enough length to accommodate an adult would find the skateboard much longer than necessary and hence difficult to maneuver.

Despite the problem discussed above, skateboards have taken the place of much amusement time previously occupied by roller skates such as of the type disclosed by U.S. Pat. Nos. 2,190,316; 3,309,098; 3,635,854; and 3,993,318.

DISCLOSURE OF INVENTION

An object of the present invention is to provide an improved skateboard having an adjustable length so as to be usable by either children or adults.

In carrying out the above object, the skateboard constructed in accordance with the invention includes a front member having a front set of wheels and a rear member having a rear set of wheels. An intermediate insert of the skateboard is selectively positioned between the front and rear members or removed therefrom to provide extended and retracted lengths of the skateboard. Connectors on the front and rear members and on the intermediate insert are provided for securing the insert between the front and rear members in the extended length or for securing the front and rear members directly to each other in the retracted length.

Both children and adults can conveniently use this skateboard due to its adjustable length. A child using the skateboard will remove the insert from between the front and rear members so as to provide a skateboard having a length which is not so long as to prevent the child from conveniently maneuvering the skateboard as it is ridden. An adult using the skateboard will secure the insert between the front and rear members to provide sufficient standing area for riding of the skateboard.

In the preferred construction, the connectors of the skateboard include at least one male connector on one of the members and at least one female connector on the other member, such that the male connector on the one member is received by the male connector on the other member to directly secure the front and rear members to each other in the retracted length. At least one male connector and at least one female connector are also provided on the intermediate insert for securing the insert between the front and rear members to the connectors thereof in the extended length.

A pair of locking devices are also preferably provided for the connectors. One of the locking devices is used singly to lock the connectors on the front and rear members directly to each other in the retracted length. Both of the locking devices cooperate to lock the connectors on the front and rear members to the connectors on the intermediate insert in the extended length. The locking devices preferably comprise threaded fasteners that extend through the mated male and female connectors to provide locking thereof to each other. A clamp is also preferably provided on the insert to secure one of the threaded fasteners thereto when the skateboard is being used in its retracted length with the insert removed.

In the preferred construction, the male and female connectors have rectangular cross-sections that mate with each other. A pair of laterally spaced sets of the male and female connectors are most preferably provided on the front and rear members and on the insert in order to provide rigidity to the skateboard during use. Lower surfaces on the front and rear members on which the front and rear sets of wheels are mounted and a lower surface on the insert are disclosed as having the connectors mounted thereon preferably by associated mounting plates.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
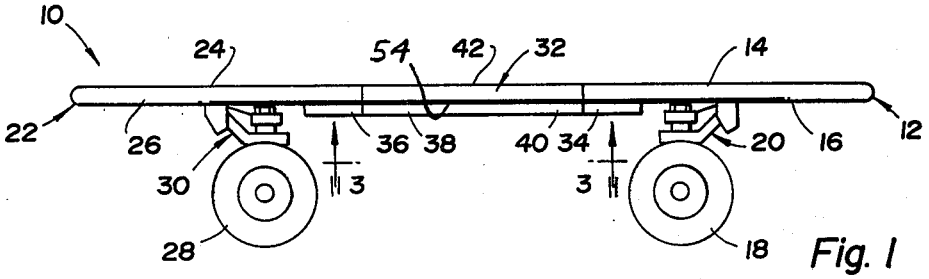
FIG. 1 is a side elevation view of a skateboard constructed in accordance with the present invention and illustrated in an extended length.
Figure 2:
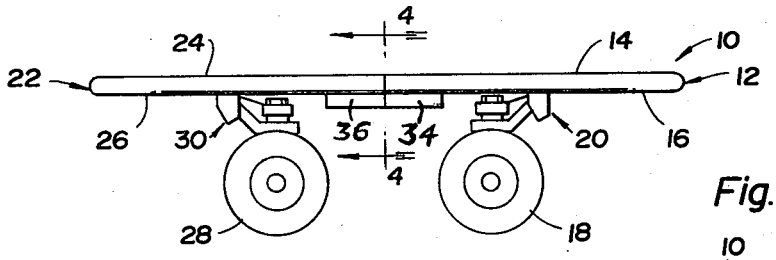
FIG. 2 is a side elevation view of the skateboard taken in the same direction as FIG. 1 but illustrated in a retracted length.

Referring to FIG. 1 of the drawings, a skateboard constructed in accordance with the present invention is generally indicated by reference numeral 10 and includes a front member 12 having an upper surface 14 on which the rider stands and a lower surface 16 on which a front set of wheels 18 is mounted by a bracket and axle assembly generally indicated by 20. Skateboard 10 also includes a rear member 22 having an upper surface 24 on which the rider stands and a lower surface 26 on which a rear set of wheels 28 is mounted by a combined bracket and axle assembly generally indicated by 30. An intermediate insert 32 of the skateboard is selectively positioned between the front and rear members 12 and 22 to provide an extended length as illustrated in FIG. 1 or is removed therefrom to provide a retracted length of the skateboard as illustrated in FIG. 2. Connectors 34, 36, 38, and 40 illustrated on the front and rear members 12 and 22 and on the intermediate insert 32 as shown in FIG. 3 are provided for securing the insert between the front and rear members in the extended length shown in FIG. 1 or for securing the front and rear members directly to each other in the retracted length shown in FIG. 2.

An adult desiring to ride the skateboard will utilize the insert 32 positioned between the front and rear members 12 and 22 such that its upper surface 42 cooperates with the upper surfaces 14 and 24 on the front and rear members to provide sufficient standing area. When a child desires to use the skateboard 10, the insert 32 is removed and the front and rear members 12 and 22 are secured directly to each other in the retracted length that allows the child to conveniently maneuver the skateboard in a manner the child cannot accomplish with the longer extended length which is more difficult to control.

Figure 3:
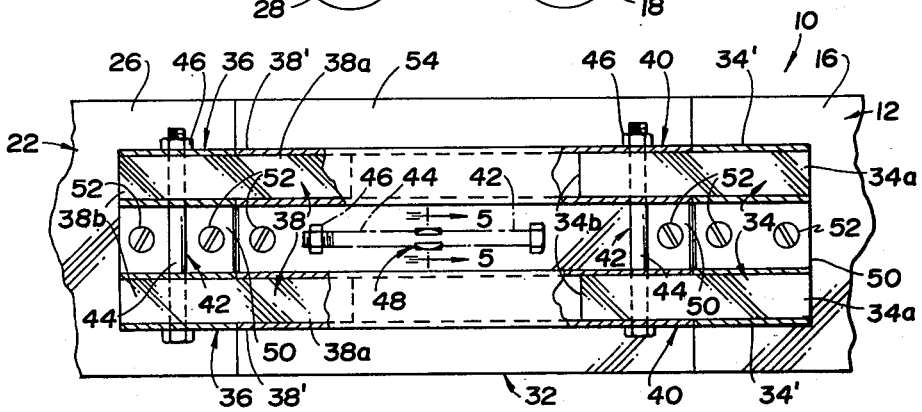
FIG. 3 is a bottom plan view illustrating connectors that are utilized to secure the skateboard in either the extended or retracted length.

As illustrated in FIG. 3, the skateboard is disclosed as having a pair of laterally spaced sets of the connectors 34, 36, 38 and 40 which are used to provide securement of the skateboard in either its extended or retracted length. Two of the connectors comprise male connectors 34 which have first ends **34*a* mounted on the front member 12 of the skateboard and have second ends 34*b* that project rearwardly. Two female connectors 36 on the rear member 22 have tubular constructions for receiving the ends 34*b* of connectors 34 when the insert 32 is removed to provide the retracted length of the skateboard. Two male connectors 38 have ends 38*a* mounted on the insert 32 and have ends 38*b* which are received by the female connectors 36 on the rear member 22 to secure the insert thereto in the extended position of the skateboard. Likewise, two female connectors 40 on the insert 32 have tubular constructions that open forwardly to receive the ends 34*b* of the male connectors 34 on the front member 12** in order to provide securement of the insert thereto in the extended length of the skateboard.

With continuing reference to FIG. 3, skateboard 10 also includes a pair of locking devices 42. One of the locking devices 42 is used singly to lock the male and female connectors 34 and 36 directly to each other in the retracted length of the skateboard. Both of the locking devices 42 are utilized to lock the male connectors 34 to the female connectors 40 and to lock the male connectors 38 to the female connectors 36 in the extended length of the skateboard. Locking devices 42 preferably comprises threaded fasteners in the form of bolts 44 that extend through aligned holes in the mated male and female connectors 34, 36, 38, and 40 to provide locking of the connectors to each other in either the extended or retracted length of the skateboard as previously described. After insertion of the bolts 44 through the mated connectors, nuts 46 are threaded onto the bolt ends to hold the bolts in position.

Figure 5:
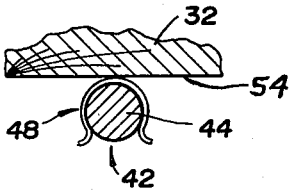
FIG. 5 is a sectional view taken along the direction of line 5—5 in FIG. 3 to illustrate a clamp for securing a threaded locking device of the skateboard to an intermediate insert thereof for storage when the skateboard is being used in its retracted length.

With combined reference to FIGS. 3 and 5, the insert 32 preferably includes a clamp 48 for releasably securing one of the threaded fasteners 42 thereto when the skateboard is being used in the retracted position with the insert removed. It should also be noted that the projecting ends **38*b* of the male connectors on the insert 32 and the female connectors 40 on the insert have aligned holes in which the locking bolt 44 can also be inserted for storage with the associated nut 46** being threaded thereto to provide securement in the stored position.

Figure 4:
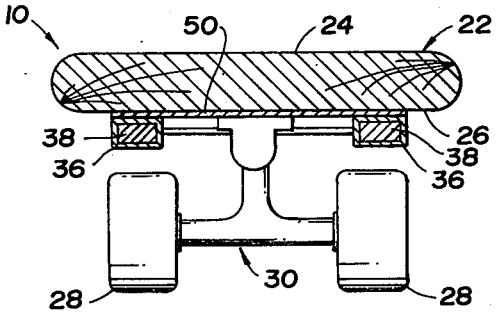
FIG. 4 is a sectional view taken through the skateboard along the direction of line 4—4 in FIG. 2.

As illustrated in FIG. 4, the male and female connectors have rectangular cross-sections which are preferably elongated in a horizontal direction. Mounting plates 50 on the front and rear members 12 and 14 and on the insert 32 are secured in any suitable manner to the connectors such as by welding. Any suitable type of connection such as fasteners 52 are utilized to secure the mounting plates 50 to the lower surfaces 16 and 26 of the front and rear members and to the lower surface 54 of the insert 32.

It will also be noted as illustrated in FIG. 3 that each male connector 34 has a tubular sleeve 34' in which its end **34*a* is secured in any suitable manner such as by welding. Sleeves 34' have cross-sections identical to the female connectors and are secured in any suitable manner such as by welding to the associated mounting plate 50. Each male connector 38 likewise has a tubular sleeve 38' which is an extension of the aligned female connector 40 on the intermediate insert 32. The end 38*a* of each male connector 38 is secured in any suitable manner such as by welding within the associated sleeve 38' which as a cross-section identical to the female connectors 36 and 40. Any suitable type of connection such as welding secures the sleeve 38' to the associated mounting plate 50. Sleeves 34' and 38' provide for alignment of the male connectors 34 and 38 with the female connectors upon securement of the front and rear members 12 and 22 in either the extended or retracted length of skateboard 10**.

While the best mode for carrying out the invention has been described in detail, those familiar with the art to which this invention relates will recognize various alternative designs and embodiments for practicing the invention as defined by the following claims.

What is claimed is:

1. A skateboard comprising: a front member having a front set of wheels; a rear member having a rear set of wheels; an intermediate insert that is selectively positioned between the front and rear members or removed therefrom to permit the skateboard to be used in extended or retracted lengths, wherein the upper surface is adapted to support both feet of the rider; connectors on the front and rear members and on the intermediate insert for securing the insert between the front and rear members in the extended length or for securing the front and rear members directly to each other in the retracted length, said connectors including at least one male connector on one of said members, at least one female connector on the other member for receiving the male connector on the one member to directly secure the front and rear members to each other in the retracted length, at least one male connector and at least one female connector on the intermediate insert for securing the insert between the front and rear members to the connectors thereof in the extended length; and a pair of locking devices one of which is used singly to lock the connectors on the front and rear members directly to each other in the retracted length and both of which cooperate to lock the connectors on the front and rear members to the connectors on the intermediate insert in the extended length.

2. A skateboard as in claim 1 wherein the locking devices comprise threaded fasteners that extend through the mated male and female connectors to provide locking thereof to each other.

3. A skateboard as in claim 2 wherein the insert includes a clamp for releasably securing one of the threaded fasteners thereto when the skateboard is being used in its retracted length with the insert removed.

4. A skateboard as in claim 1 wherein the male and female connectors have rectangular cross-sections.

5. A skateboard as in claim 1, 2, 3, or 4 which includes a pair of laterally spaced sets of the male and female connectors on the front and rear members and on the insert.

6. A skateboard as in claim 5 wherein the front and rear members and the insert have lower surfaces on which the connectors are mounted.

7. A skateboard as in claim 6 wherein the front and rear members and the insert include mounting plates that support the connectors on their lower surfaces.

8. A skateboard comprising: a front member having a lower surface and including a front set of wheels mounted on the lower surface thereof; a rear member having a lower surface and including a rear set of wheels mounted on the lower surface thereof; an intermediate insert that is selectively positioned between the front and rear members or removed therefrom to permit the skateboard to be used in extended or retracted lengths wherein the upper surface is adapted to support both feet of the rider; said intermediate insert having a lower surface; laterally spaced sets of male and female connectors secured to the lower surfaces on the front and rear members and on the intermediate insert; said sets of connectors including a pair of male connectors on one of the members and a pair of female connectors on the other member for receiving the male connectors on the one member to directly secure the front and rear members to each other in the retracted length of the skateboard; said sets of connectors also including a pair of male connectors and a pair of female connectors on the insert for securing the insert between the front and rear members to the connectors thereof in the extended length; and a pair of locking devices one of which is used singly to lock the connectors on the front and rear members directly to each other in the retracted length and both of which cooperate to lock the connectors on the front and rear members to the connectors on the insert in the extended length.

* * * * *